US006496589B1

(12) United States Patent
Pham et al.

(10) Patent No.: US 6,496,589 B1
(45) Date of Patent: Dec. 17, 2002

(54) HEADSET WITH OVERMOLD

(75) Inventors: Hoa Pham, St. Paul, MN (US); Michael Carpenter, Brooklyn Park, MN (US)

(73) Assignee: Telex Communications, Inc., Burnsville, MN (US)

( * ) Notice: Subject to any disclaimer, the term of this patent is extended or adjusted under 35 U.S.C. 154(b) by 0 days.

(21) Appl. No.: 09/885,143

(22) Filed: Jun. 20, 2001

(51) Int. Cl.[7] ..... H04R 25/00
(52) U.S. Cl. ..... 381/375; 381/370
(58) Field of Search ..... 381/370–379; 379/431, 430

(56) References Cited

U.S. PATENT DOCUMENTS

| | | | | |
|---|---|---|---|---|
| 2,686,231 | A | * | 8/1954 | Stevens |
| 2,954,442 | A | | 9/1960 | Mickenberg ..... 179/156 |
| 3,031,539 | A | | 4/1962 | Schuster et al. ..... 179/156 |
| 3,119,904 | A | * | 1/1964 | Anson |
| D211,951 | S | | 8/1968 | Thomson et al. ..... D26/14 |
| 4,039,765 | A | * | 8/1977 | Tichy et al. |
| D286,632 | S | | 11/1986 | Teunis ..... D14/36 |
| 4,875,233 | A | * | 10/1989 | Derhaag et al. |
| 5,369,857 | A | | 12/1994 | Sacherman et al. ..... 29/594 |
| 5,457,751 | A | | 10/1995 | Such ..... 381/183 |
| D365,559 | S | | 12/1995 | Fathi ..... D14/142 |
| 5,504,812 | A | | 4/1996 | Vangarde ..... 379/430 |
| 5,721,775 | A | | 2/1998 | Leifer ..... 379/430 |
| 5,740,263 | A | * | 4/1998 | Liao |
| D394,058 | S | | 5/1998 | Fitzgerald ..... D14/142 |
| D394,436 | S | | 5/1998 | Hall et al. ..... D14/206 |
| 5,793,865 | A | | 8/1998 | Leifer ..... 379/430 |
| 5,793,878 | A | * | 8/1998 | Chang |
| D405,786 | S | | 2/1999 | Leifer ..... D14/142 |
| D410,921 | S | | 6/1999 | Luchs et al. ..... D14/142 |
| 6,016,347 | A | | 1/2000 | Magnasco et al. ..... 379/430 |
| 6,178,251 | B1 | * | 1/2001 | Luchs et al. |

OTHER PUBLICATIONS

HELLO–Direct (Catalog of Telephone Products), Jul. 1993.*

* cited by examiner

*Primary Examiner*—Sinh Tran
(74) *Attorney, Agent, or Firm*—Fredrikson & Byron, P.A.

(57) ABSTRACT

A headset is disclosed having a headband configuration that distributes the compression forces on the user's head to provide firm placement without causing discomfort to the user. The headband is preferably integrally formed with a soft overmold molded along a portion of its interface with the user's head. The headband terminates in first and second ends. Either or both ends may terminate in a flared temple pad for further distribution of compression forces or may terminate in an earphone. A boom is pivotally connected to either a temple pad or an earphone and is optionally conformable for positioning towards the wearer's mouth. The boom terminates in a microphone.

17 Claims, 4 Drawing Sheets

HEADSET WITH OVERMOLD

BACKGROUND OF THE INVENTION

1. Field of the Invention

The present invention relates to electronic headsets, and more particularly, to microphone headsets.

2. Description of the Related Art

Headsets are commonly used by musicians, coaches, telephone operators, and others who need to keep their hands available while speaking and/or listening. Typically these headsets will have a headband passing over the user's head, with earphones at each end of the headband or an earphone and a temple pad at opposite ends of the headband. Frequently, a microphone is positioned at the end of a boom extending from the headband. The headset maintains its position by exerting a compressive force upon the user's head.

Typically, the headband is resilient and shaped in an arc so that it must be slightly sprung to fit over the head; the resulting friction force holds the band in place on the typical headset. A key component of the headset design, therefore, is the headband.

The headset desirably is comfortable for long wear. A common source of discomfort in many headbands is pressure concentrated against the temple or outer ear by the temple pad or earphone respectively. It is desirable that the headband exert sufficient pressure to stay firm against the head yet not cause discomfort. On the other hand, should too little pressure be exerted, the headset may become loose and slide from the user's head.

A certain amount of compressive force is required to hold the headset in place. Headsets often concentrate the compressive pressure only at the temple or ears. This results in a number of problems. First, the user may suffer considerable discomfort as a result of the concentrated force. Second, even if the temple pad and/or the earphones remain in place, the headband may slip from its position over the head. This results in the boom and microphone being moved from its position near the user's mouth. Furthermore, if the headband slips, its weight may then cause the temple pad and/or earphone to slip from place. Third, the extra compressive force at the temple or earphone causes the space between the temple and temple pad and/or ear and earphone to be less penetrable to air. This in turn increases the probability of that area becoming excessively warm, resulting in the user perspiring. The perspiration causes the area to become moist and may increase the likelihood of the temple pad or earphone slipping from its position.

It is desirable to provide a headset that is highly stable, and does not come loose upon head movement by the user. This is particularly crucial for headsets used by musicians where there may be a large amount of head movement. Additionally, a musician may be using his or her hands to play an instrument, etc. and therefore would not have easy mobility for repositioning the headset should it slip from place. Furthermore, the headset should be both tough to avoid damage and light in weight so as not to tire the user.

Preferably, the headset should also be easy and inexpensive to manufacture.

The prior art fails to provide a headset that enables the user to wear the headset for long periods of time without undue discomfort while providing a secure fit that will prevent the headset from dislodging under the range of motions possible during use.

SUMMARY OF THE INVENTION

The invention is a headset for use with a microphone and, optionally, an earphone. The headset provides a stable, comfortable fit by distributing the compressive force required for positioning the headset over a headband as well as temple pad(s) and/or an earphone.

A headband is provided that curves over the top of the users head. The headband is preferably resilient such that it may be spring fit over a users head. Either end of the headband may be provided with either a temple pad or an earphone. The choice of termination elements depends on whether it is desirable for the user to speak and listen or merely to speak. A flared temple pad can optionally be used to distribute force at the temple. An overmold is provided over much of the headband of the headset to provide friction without providing excessive force, thereby providing a highly stable fit. The overmold distributes the force of the headband along the contact surface of the headband and the user's head, rather than at the ear or temple alone. A boom may be provided at either the temple pad or the earphone for connection to a microphone. The resulting headset is light and durable as well as easy and inexpensive to manufacture.

DETAILED DESCRIPTION OF THE DRAWINGS

Figure 1:
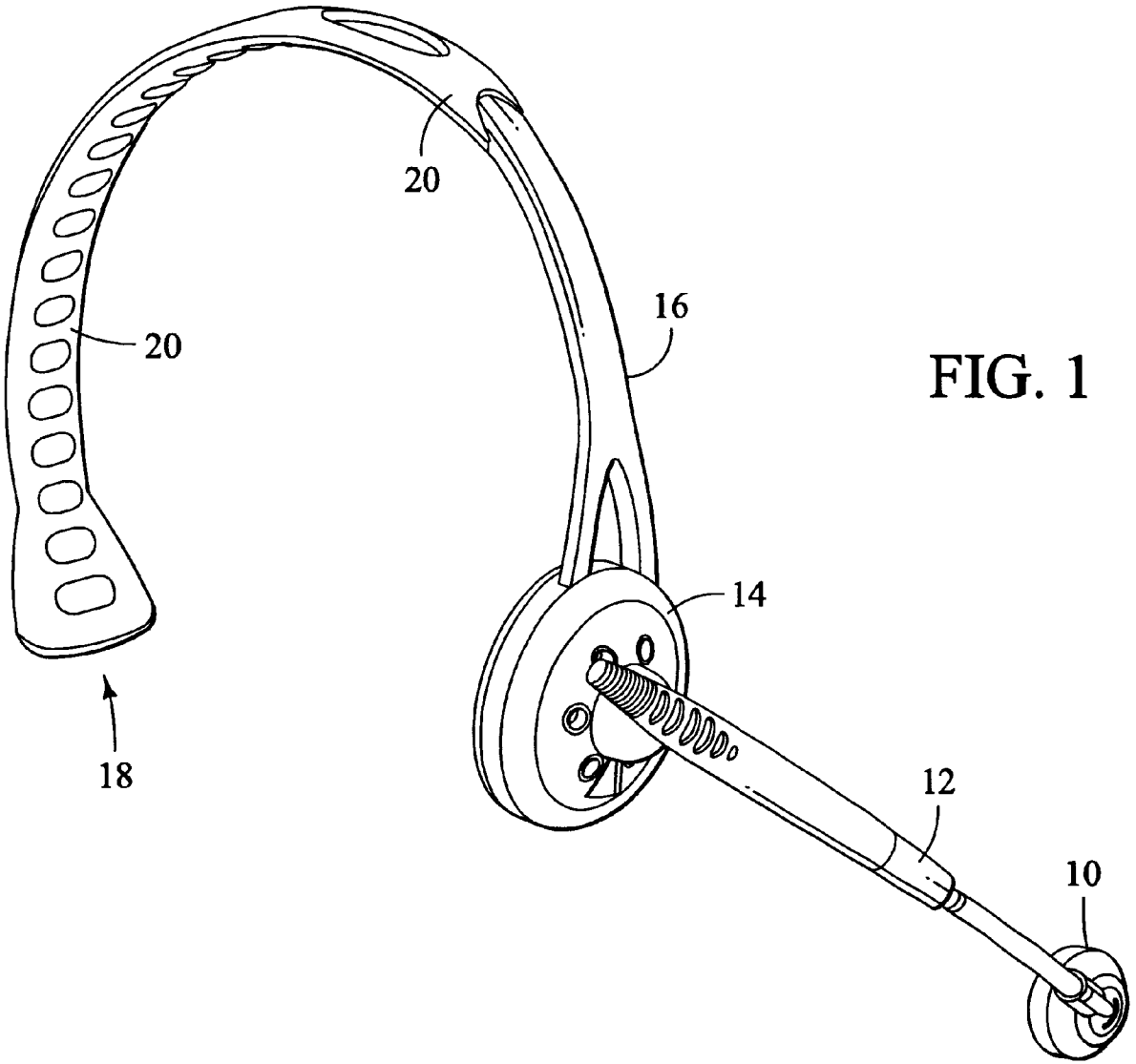
FIG. 1 is an isometric view of a first embodiment of the headset with an earphone.

To assist in an understanding of the invention, a preferred embodiment or embodiments will now be described in detail. Reference will be frequently taken to the drawings, which are summarized above. Reference numerals will be used to indicate certain parts and locations in the drawings. The same reference numerals will be used to indicate the same parts or locations throughout the drawings unless otherwise indicated.

The present invention provides a headset that is durable and comfortable for long wear. The headset distributes the compressive force required to firmly keep the headset in place on the user's head along the interface of the headband with the user's head. The force is distributed along an overmold integrally formed with the headband and optional flared temple pads at either end of the headband.

FIG. 1 depicts a first embodiment of the invention with an earphone. The headband 16 curves over the operator's head and terminates at first and second ends. A soft overmold 20 is integrally molded along a length of the interior of the headband to distribute compression forces acting upon the head. Preferably, the soft overmold 20 runs along at least the entire interior of the headband from first to second end of the headband. However, the soft overmold 20 may extend over any portion of the interior of the headband so as to help distribute compressive forces as well as to maintain frictional stability. Even more preferably, the soft overmold 20 has a plurality of raised ridges molded along the surface interfacing with the user's head. The ridges may be spaced equally.

The first end of the headband 18 terminates in a temple pad 18 further distributing the compression forces acting upon the user's head. The temple pad 18 is optionally flared and may be integrally molded with the headband 18. The second end terminates in an earphone 14. The earphone 14 may be covered with an ear cushion with the ear cushion preferably being acoustically transparent. A boom 12 is pivotally connected to the earphone 14 at the boom's proximal end. The boom's 12 distal section is optionally conformable for positioning towards the user's mouth and terminates in a microphone 10. The boom 12 may be a flexible molded boom. Optionally, the boom 12 may be pivotally connected the earphone 15. The pivotal connection is provided when the earphone has a hole, an extension of overmold is integrally molded through the hole to form a socket for receiving a ball slide, the proximal end of the boom has a ball slide connected thereto, and the ball slide is inserted into the socket.

The overmold may be coextruded with the headband to form an integral piece. Optionally, the overmold may be adhesively applied to the headband or applied in any matter consistent with the invention. The soft overmold 20 may be manufactured of soft rubber or any other suitable material. A possible construction method provides for a first part constructed via injection molded plastic. The first part is then inserted into a second injection mold using an alternate material. A soft material, such as rubber, is overmolded on the first part.

Figure 2:
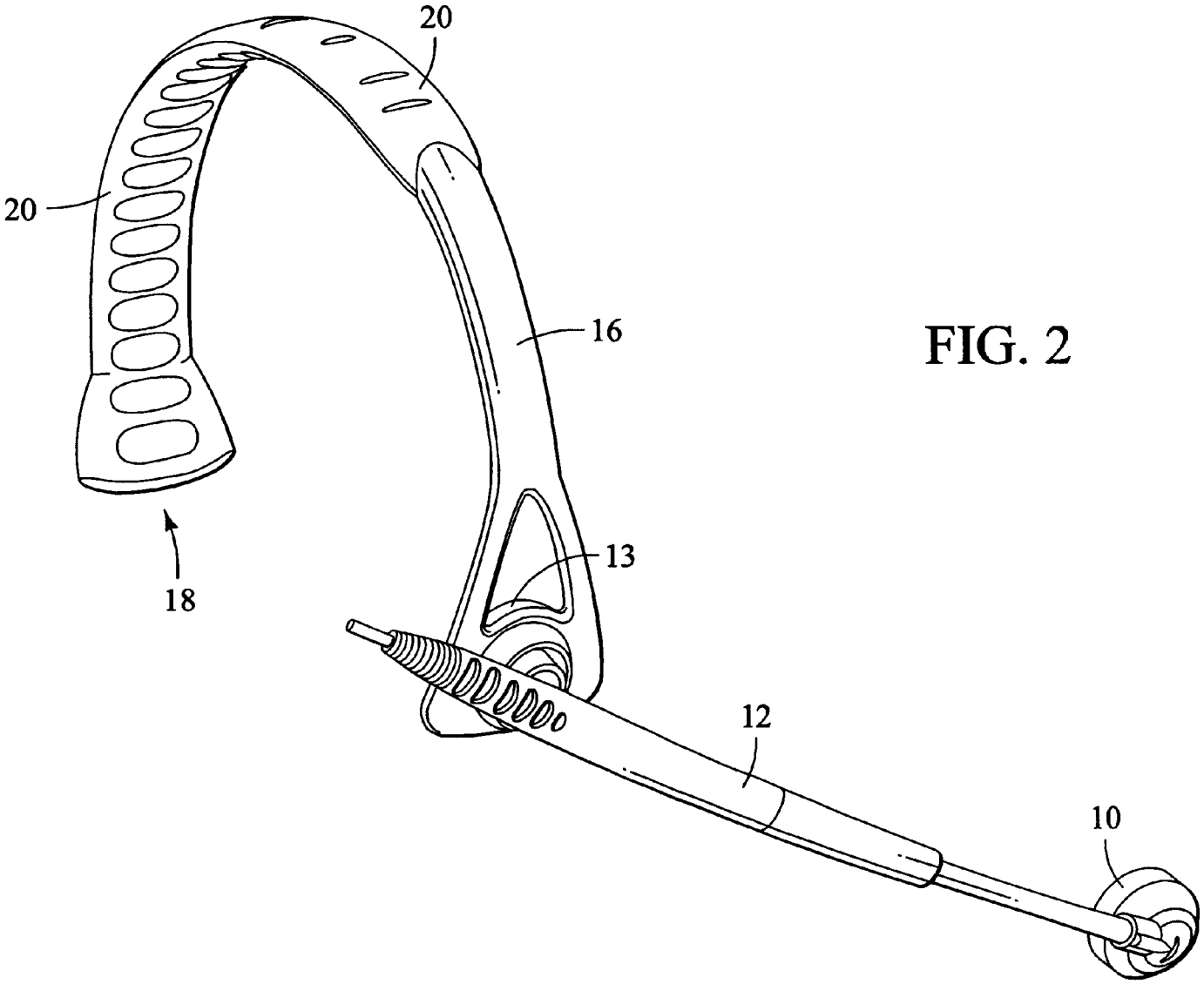
FIG. 2 is an isometric view of a second embodiment of the headset without an earphone.

As seen in FIG. 2, the invention may optionally have two temple pads, 18 and 13, in lieu of a temple pad and earphone. The headband 16 is integrally molded with a soft overmold 20 and terminates in temple pads 18 and 13 at first and second end respectively. The boom 12 is pivotally connected to second end and the distal section of the boom is optionally conformably for positioning towards the user's mouth and terminates in a microphone.

Figure 3:
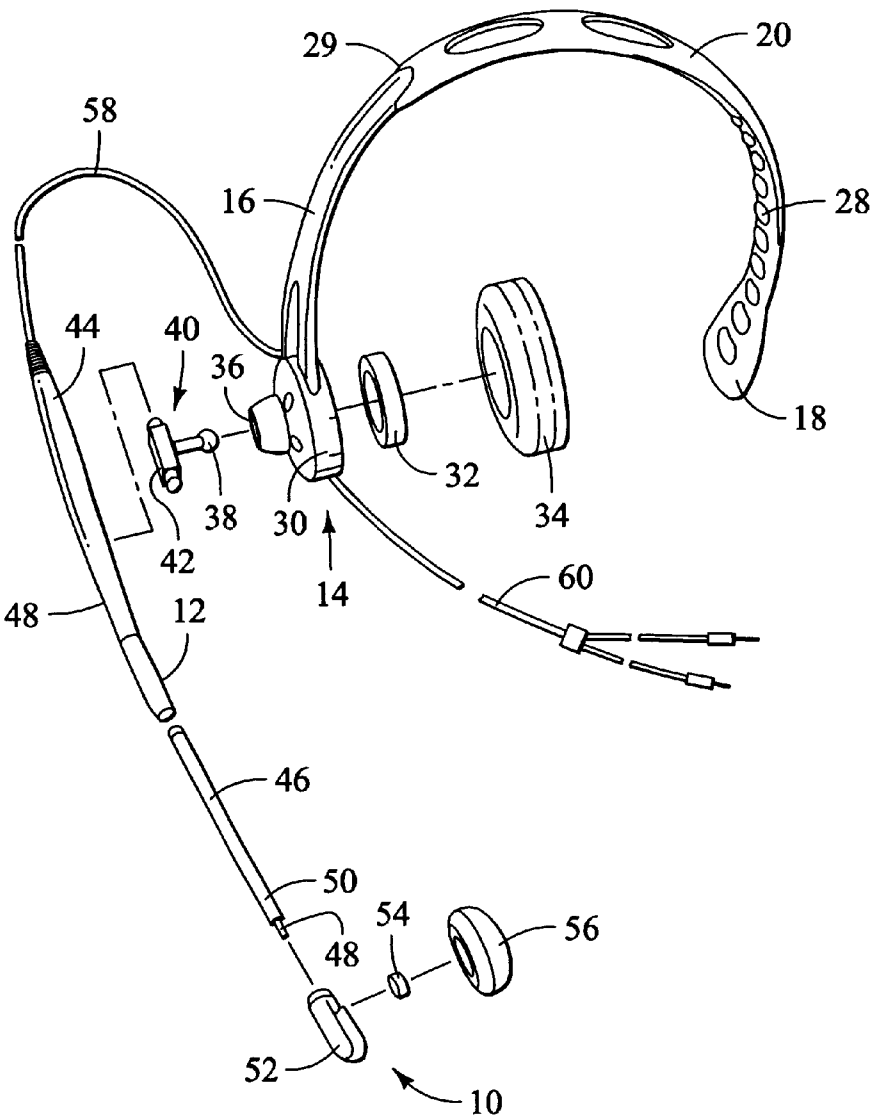
FIG. 3 is an exploded view of an embodiment of the headset of the present invention.

FIG. 3 depicts an exploded view of one embodiment of the present invention. The headband 16 terminates in a temple pad 18 at one end and an earphone 14 at the other end. An overmold 20 extends both under and over the headband 16 from the temple pad 18 to an endpoint 29. From the endpoint 29 to the earphone 14, the overmold 20 is provided only along the interior of the headband 16. Alternatively, the overmold 20 may be provided along the exterior surface of the headband 16 wherever desired. Functionality is concerned primarily with the provision of the overmold 20 along the interior surface of the headband 16. To that end, the overmold 20 should be provided along at least a portion of the interior surface of the headband 16 between the temple pad 18 and the earphone 14. Preferably, the overmold 20 is provided along the entire length of the interior surface of the headband 16 between the temple pad 18 and the earphone 14. Raised ridges 28 are provided at intervals along the interior of the overmold 20. The temple pad 18 is configured for positioning at or near the operator's temple and may, optionally, be flared.

The earphone 14 comprises an outer casing 30 for securely holding a speaker 32. The casing 30 and the speaker 32 assembly may be covered with a cushion 34. The cushion 34 may be manufactured of foam or any other suitable material such that the earphone is acoustically transparent as is known in the art. The earphone casing 30 includes a hole 36 therethrough. The hole 36 forms a socket for receiving a connection piece 38. In turn, a ball 38 of the connection piece 40 is slideably connected to the boom 12. The ball 38 and hole 36 form a pivotal ball and socket connection of the boom 12 to the headband 16. Additionally, the connection piece 40 includes a sliding piece 42 which is slideable along the boom 12. A groove 44 is provided along the edge of the boom 12 for receiving the sliding piece 42. By sliding the sliding piece 42 along the groove 44, the exact relationship of the microphone 10 to the operator may be adjusted.

The boom 12 is configured of a flexible portion 48 and a malleable portion 46. The flexible portion 48 generally comprises the proximal portion of the boom 12 and is flexible and may configured to retain its shape. The flexible portion 42 may be manufactured of a soft plastic material or any other suitable material as known to those skilled in the art. The malleable portion 46 comprises the distal portion of boom 12 and is preferably in direct connection with a microphone 10. The malleable portion 46 may be bent and shaped to adjust the angle of the microphone 10 to the operator. Generally, the malleable portion 46 includes wires 48 along its inner portion. An outer casing 50 preferably encloses wires 48.

The microphone 10 is attached to the distal end of the boom 12, preferably at the distal end of the malleable portion 46. The microphone 10 includes a microphone housing 52 as well as a noise canceling component 54. Optionally, a windscreen 56 is included over the microphone 10.

A wire 58 loosely connects the proximal portion of the boom 12 to the earphone 14. Additionally, wires 60 extend from the earphone 14 for connection to other audio equipment.

Figure 4:
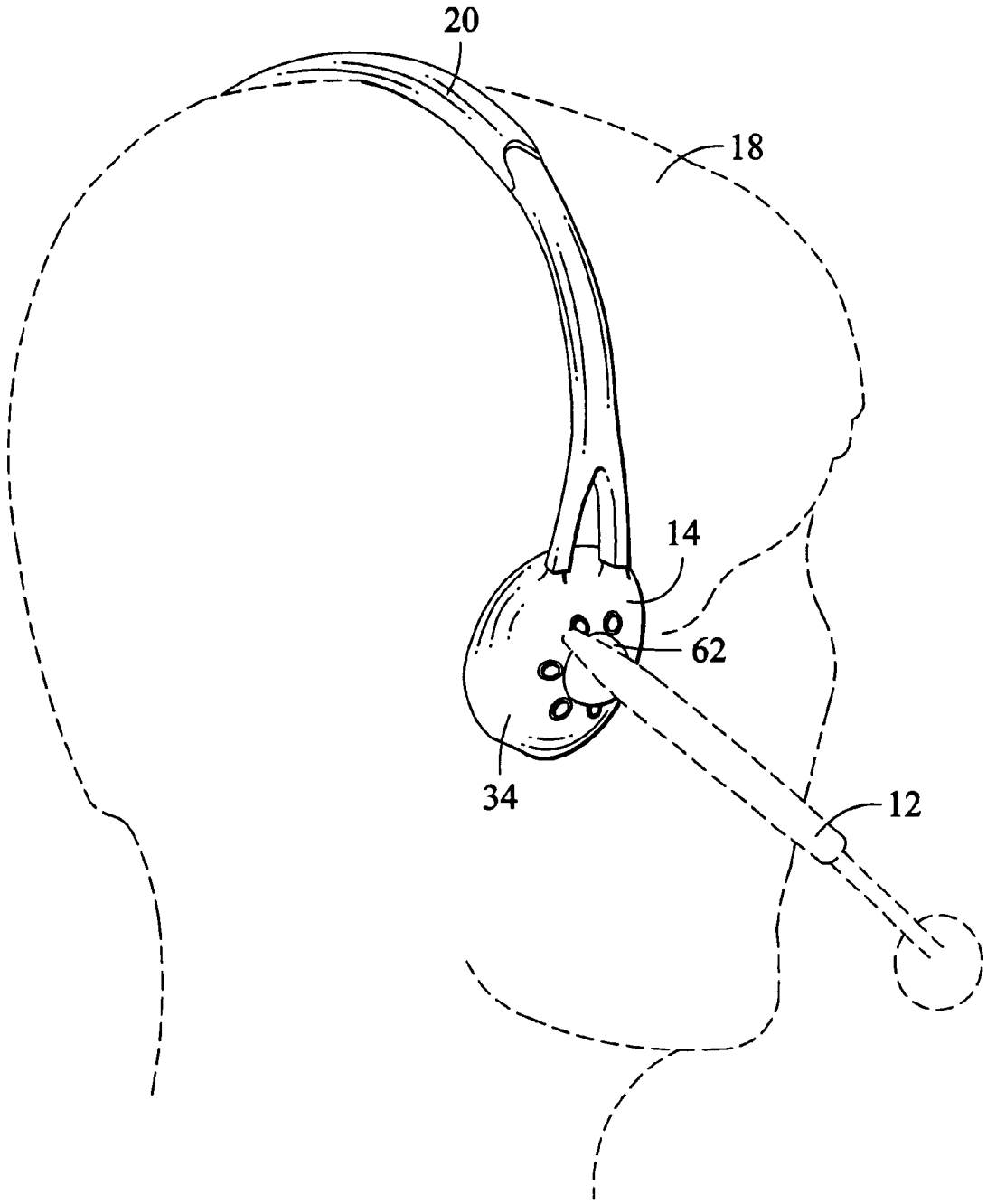
FIG. 4 is a side view of an embodiment of the headset in use over an operator's ear.

An operator wearing one embodiment of the headset of the present invention is shown in FIG. 4. The headset is comfortable for long wear by the user. The headband 18 curves over the user's head. The overmold 20 distributes the compressive force of the headband over the user's head. Optionally, the overmold 20 has a plurality of raised ridges (not shown) along its inner surface. The overmold and the ridges provide enough friction with the operator's head to prevent headband 18 from becoming loose and sliding out of position.

In the embodiment shown, the earphone 14 is covered with a cushion 34. The boom 12 (in dotted lines) connects to the earphone 14 at a ball-and-socket joint 62. The opposite end of the headband 18 from the earphone 14 terminates in a temple pad (not shown). The temple pad works with the overmold 20 to distribute compressive forces along the headset. Thus, sufficient pressure is exerted to cause the headset to remain firmly in place against the head and yet not cause discomfort.

While particular embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A microphone headset, comprising:

a headband curved to conform to a wearer's head and comprised of a resilient material so as to compress against the wearer's head when flexed open by the wearer's head, the headband terminating at an end in a temple section, the temple section being a flared section integrally molded into the headband and being adapted for positioning against the wearer's temple;

a cushioning overmold integrally molded on most of the length of the headband to cushion the headband compression force against the wearer's head, the cushioning overmold being conformable to the wearer's head to increase the surface area that contacts the wearer's head and thereby distribute the compression force over a greater surface area, wherein the temple section is covered by the overmold; and a microphone boom having a boom and connected to the other end of the headband.

2. The headset of claim 1, wherein the headband terminates at the other end in an earphone.

3. The headset of claim 1, wherein the boom is pivotally connected to the earphone.

4. A microphone headset, comprising:

a headband curved to conform to a wearer's head and comprised of a resilient material so as to compress against the wearer's head when flexed open by the wearer's head, the headband terminating at an end in an earphone;

a cushioning overmold integrally molded on most of the length of the headband to cushion the headband compression force against the wearer's head, the cushioning overmold being conformable to the wearer's head to increase the surface area that contacts the wearer's head and thereby distributing the compression force over a greater surface area; and a microphone boom having a boom and connected to the earphone;

wherein the overmold extends from an inner surface of the headband through a hole in earphone to form a socket, the socket receiving a ball piece extending from the microphone boom, the socket and ball piece interface forming a joint providing pivotal connection of the boom and the headband.

5. The headset of claim 4, wherein the ball piece and the boom are slideably coupled to permit sliding of the boom with respect to the ball piece.

6. A microphone headset, comprising:

a headband curved to conform to a wearer's head and comprised of a resilient material so as to compress against the wearer's head when flexed open by the wearer's head, the headband terminating at one end in a temple section, the temple section comprising a flared section integrally molded into the headband, wherein the temple section terminates at a location on the wearer's head above the wearer's ear canal and is adapted for positioning against the wearer's temple;

a cushioning overmold adhered to some of the length of the headband, including the temple section, to cushion the headband compression force against the wearer's head, the cushioning overmold being conformable to the wearer's head to increase the surface area that contacts the wearer's head, thereby distributing the compression force over a greater surface area; and a microphone boom having a microphone and connected to the other end of the headband having the temple section.

7. The headset of claim 6, wherein the overmold is molded over most of the length of the headband.

8. The headset of claim 6, wherein the overmold is integrally molded on only an inner surface of the headband along a portion of the length of the headband.

9. The headset of claim 6, wherein the overmold extends along the entire length of an inner surface of the headband.

10. The headset of claim 9, wherein the overmold further comprises a plurality of raised ridges spaced apart at equal intervals along the inner side of the headband.

11. The headset of claim 6, wherein the overmold is comprised of soft rubber.

12. The headset of claim 6, wherein the overmold is integrally molded along a portion of the length of the headband.

13. A microphone headset, comprising:

a headband curved to conform to a wearer's head and comprised of a resilient material so as to compress against the wearer's head when flexed open by the wearer's head, the headband terminating at one end in a temple section, the temple section adapted for being positioned against the wearer's temple;

a cushioning overmold adhered to some of the length of the headband, including the temple section, to cushion the headband compression force against the wearer's head, the cushioning overmold being conformable to the wearer's head to increase the surface area that contacts the wearer's head, thereby distributing the compression force over a greater surface area wherein the overmold extends from an inner surface of the headband through a hole in the temple section to form a socket, the socket receiving a ball piece extending from the microphone boom to form a joint that provides pivotal connection of the boom and the headband; and a microphone boom having a microphone and connected to the end of the headband having the temple section.

14. The headset of claim 13, wherein the ball piece and the boom are slideably coupled to permit sliding of the boom with respect to the ball piece.

15. A microphone headset, comprising:

a headband curved to conform to a wearer's head and comprised of a resilient material so as to compress against the wearer's head when flexed open by the wearer's head, the headband terminating at both ends in temple sections, the temple sections adapted for being positioned against the wearer's temples;

a cushioning overmold molded on the entire inner surface of the headband, including the temple sections, to cushion the headband compression force against the wearer's head, the cushioning overmold being conformable to the wearer's head to increase the surface area that contacts the wearer's head, thereby distributing the compression force over a greater surface area wherein the overmold extends from an inner surface of the headband through a hole in one of the temple sections to form a socket, the socket receiving a ball piece extending from the microphone boom, the socket and ball piece interface forming a joint providing pivotal connection of the boom and the headband; and a microphone boom having a microphone connected to one of the temple sections.

16. The headset of claim 15, wherein the boom is slideably coupled to the headband.

17. The headset of claim 15, wherein the boom comprises a bendable section for bending the microphone to a position adjacent the wearer's mouth.

* * * * *